US010840595B2

(12) United States Patent
Lamontagne et al.

(10) Patent No.: US 10,840,595 B2
(45) Date of Patent: Nov. 17, 2020

(54) CONJOINT BEAM SHAPING SYSTEMS AND METHODS

(71) Applicant: FLIR SYSTEMS, INC., Wilsonville, OR (US)

(72) Inventors: Patrick Lamontagne, Laval (CA); Alexandre Marsolais, Laval (CA)

(73) Assignee: FLIR Systems, Inc., Wilsonville, OR (US)

( * ) Notice: Subject to any disclaimer, the term of this patent is extended or adjusted under 35 U.S.C. 154(b) by 290 days.

(21) Appl. No.: 15/910,956

(22) Filed: Mar. 2, 2018

(65) Prior Publication Data

US 2018/0261917 A1 Sep. 13, 2018

Related U.S. Application Data

(60) Provisional application No. 62/470,020, filed on Mar. 10, 2017.

(51) Int. Cl.
*H01Q 3/36* (2006.01)
*H01Q 3/28* (2006.01)

(52) U.S. Cl.
CPC ..... *H01Q 3/36* (2013.01); *H01Q 3/28* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,766,437 | A | 8/1988 | Schmidt et al. | |
| 5,132,690 | A | 7/1992 | Martin | |
| 5,675,343 | A | 10/1997 | Champeau | |
| 6,085,076 | A * | 7/2000 | Lindsay | H04B 7/0604 455/133 |
| 6,107,964 | A | 8/2000 | Hirabe | |
| 7,026,989 | B1 | 4/2006 | Minkoff et al. | |
| 7,119,733 | B2 | 10/2006 | Schoeberl et al. | |
| 7,268,722 | B2 | 9/2007 | Gottwald et al. | |
| 7,440,526 | B2 * | 10/2008 | Dinur | H04B 7/0808 375/340 |
| 9,455,764 | B2 * | 9/2016 | Mushkin | H04B 1/713 |
| 10,448,411 | B1 * | 10/2019 | Jorgovanovic | H04B 1/00 |
| 2007/0279303 | A1 | 12/2007 | Schoebel | |
| 2008/0064353 | A1 * | 3/2008 | McBeath | H04B 7/0619 455/187.1 |
| 2011/0057844 | A1 * | 3/2011 | Watanabe | H01Q 21/08 343/700 MS |
| 2011/0109495 | A1 | 5/2011 | Takeya et al. | |
| 2014/0140709 | A1 * | 5/2014 | Ganter | H01Q 21/08 398/202 |

(Continued)

*Primary Examiner* — Mamadou L Diallo
(74) *Attorney, Agent, or Firm* — Haynes and Boone, LLP

(57) ABSTRACT

Techniques are disclosed for conjoint beam shaping for optimizing radar and sonar performance. A method may include determining a system pattern of an antenna system based at least on a first antenna pattern and a second antenna pattern. The first antenna pattern may be based on first antenna parameters. The second antenna pattern may be based on second antenna parameters. The method may further include determining a score based at least on the determined system pattern and reference information. The method may further include adjusting the first antenna parameters and second antenna parameters based at least on the score. Related systems and devices are also disclosed.

20 Claims, 11 Drawing Sheets

(56) References Cited

U.S. PATENT DOCUMENTS

2015/0241493 A1* 8/2015 Canne ..... G01R 29/0814
324/612
2019/0327124 A1* 10/2019 Lai ..... H04W 72/0413

* cited by examiner

CONJOINT BEAM SHAPING SYSTEMS AND METHODS

CROSS-REFERENCE TO RELATED APPLICATIONS

This application claims the benefit of and priority to U.S. Provisional Patent Application No. 62/470,020 filed Mar. 10, 2017 and entitled "CONJOINT BEAM SHAPING," which is incorporated herein by reference in its entirety.

TECHNICAL FIELD

One or more embodiments relate generally to wireless communications and more particularly, for example, to conjoint beam shaping for optimizing detection volume of a ranging system.

BACKGROUND

Antennas are utilized for transmission and/or reception of signals via wireless channels. Wireless connectivity may be propagated to facilitate communication between devices alternative to or in addition to wired connections. In some cases, wireless connectivity may be provided where wired connections are difficult, cumbersome, and/or costly to implement. Furthermore, antenna patterns of the antennas may be selected to facilitate better signal transmission and/or reception along particular directions.

SUMMARY

In one or more embodiments, a method includes determining a system pattern of an antenna system based at least on a first antenna pattern (e.g., pattern of transmission antenna) and a second antenna pattern (e.g., pattern of reception antenna). The first antenna pattern is based on first antenna parameters. The second antenna pattern is based on second antenna parameters. The method further includes determining a score based at least on the determined system pattern and reference information. The method further includes adjusting the first antenna parameters and/or the second antenna parameters based at least on the score.

In one or more embodiments, a device includes one or more processors. The device further includes a non-transitory machine readable medium including instructions stored therein, which when executed by the one or more processors, cause the one or more processors to perform operations. The operations include determining a system pattern of an antenna system based at least on a first antenna pattern and a second antenna pattern. The first antenna pattern is based on first antenna parameters. The second antenna pattern is based on second antenna parameters. The operations further include determining a score based at least on the determined system pattern and reference information. The operations further include adjusting the first antenna parameters and/or the second antenna parameters based at least on the score.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
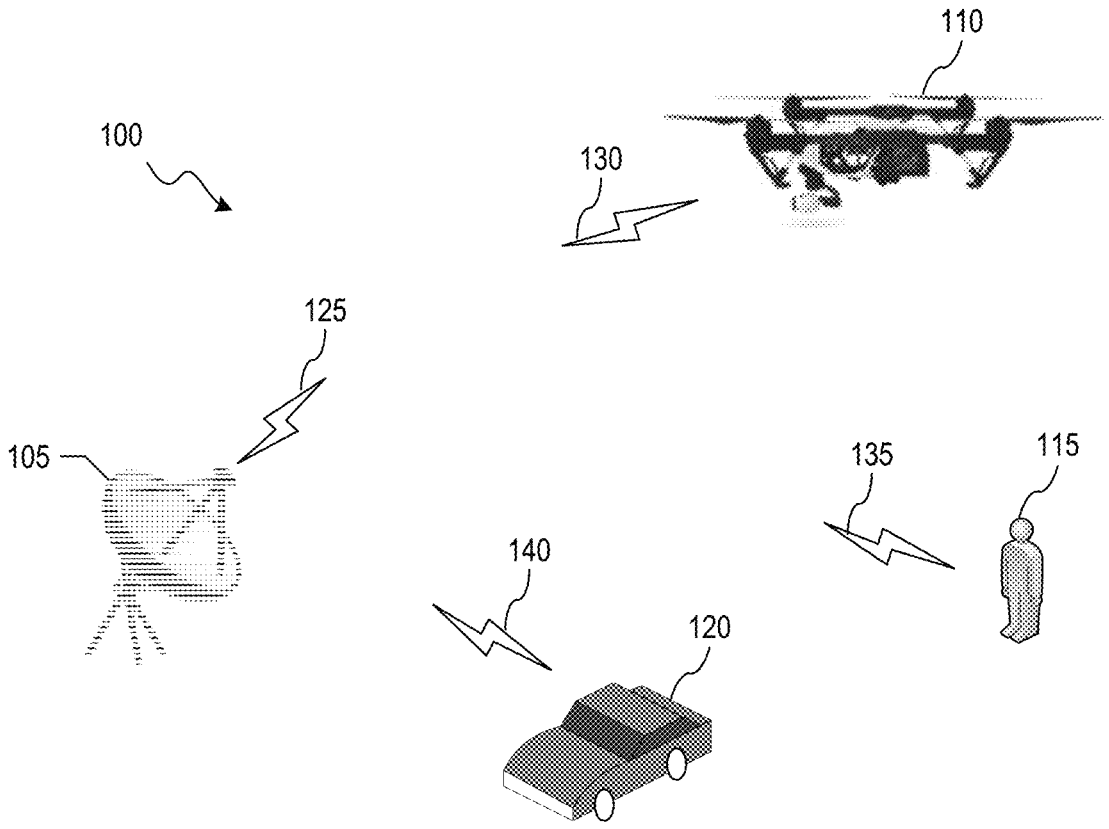
FIG. 1 illustrates an example environment in which conjoint beam shaping may be implemented in accordance with one or more embodiments of the present disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced using one or more embodiments. In one or more instances, structures and components are shown in block diagram form in order to avoid obscuring the concepts of the subject technology. One or more embodiments of the subject disclosure are illustrated by and/or described in connection with one or more figures and are set forth in the claims.

In one or more embodiments, the subject system facilitates conjoint beam shaping of transmitter (TX) and receiver (RX) radiation patterns to form an antenna system radiation pattern. In such embodiments, the antenna system includes a TX antenna array formed of one or more TX antenna elements and an RX antenna array formed of one or more RX antenna elements, in which the TX antenna array exhibits the TX radiation pattern and the RX antenna array exhibits the RX radiation pattern. The TX antenna array may be implemented based on TX antenna parameters and the RX antenna array may be implemented based on RX antenna parameters. By way of non-limiting example, the antenna parameters (e.g., TX and RX antenna parameters) may include an antenna element type (e.g., patch, dipole, slot, etc.) of each antenna element, a material(s) of each antenna element, a position and/or a disposition of each antenna element in the antenna array, a gain and/or phase shift associated with each antenna element, and/or generally any parameters that may affect the construction and/or application of the antenna array and, thus, the radiation pattern exhibited by the antenna array.

In an aspect, antenna elements may be referred to as antennas, elements, radiating elements, and/or variants thereof. In an aspect, a radiation pattern may be based on, or may be referred to as, an antenna pattern, an antenna response, a field pattern, a power pattern (e.g., power is proportional to field squared), a far-field pattern, a beam shape, a beam pattern, and/or variants thereof (e.g., an antenna field response). In an aspect, the antenna system radiation pattern may be referred to as a system pattern, a system beam shape, a total system beam shape, a system response, an overall system beam shape, a system antenna pattern, a total system antenna pattern, and/or variants thereof (e.g., an overall antenna system response).

Figure 7A:
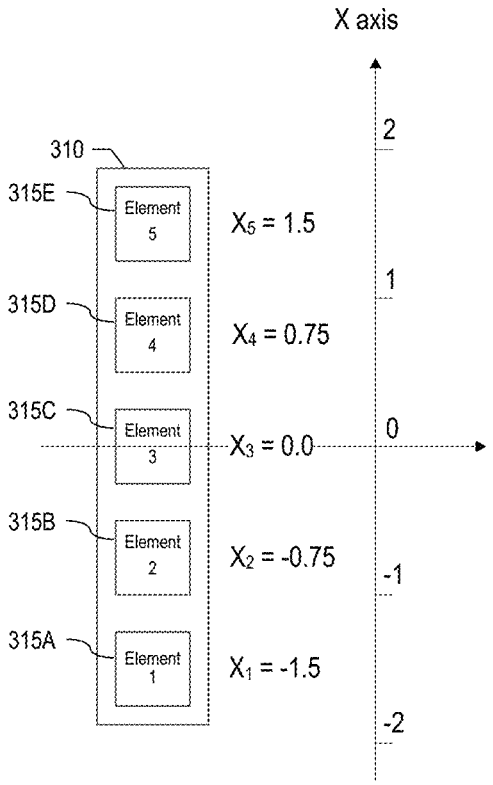
FIGS. 7A and 7B illustrate a front view and a side view, respectively, of a transmitter antenna array in accordance with one or more embodiments of the present disclosure.
Figure 7B:
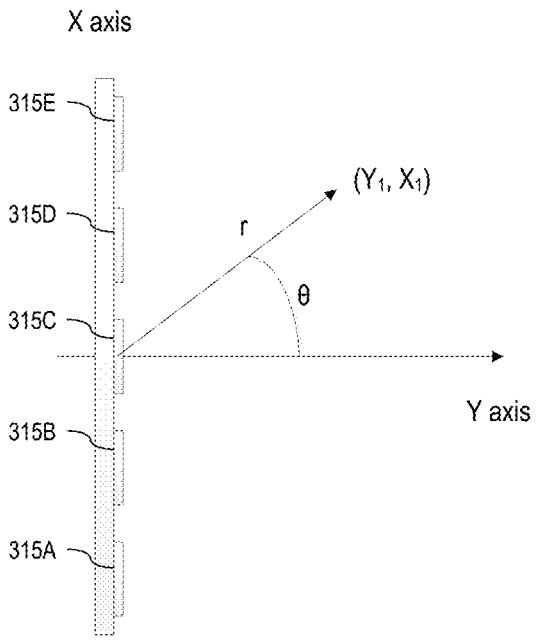

An antenna pattern of an antenna array may be based on each antenna element's radiation pattern (also referred to as element factor) and an array factor of the antenna array. In an aspect, an antenna array may include a set of antenna elements that can be considered as working together as a single antenna element. In some cases, an antenna array may be a single antenna element. For the case that antenna elements of the antenna array are identical, or may be considered to be identical (e.g., approximately identical), the radiation pattern of the antenna array may be given by $$S(\theta)=S_e(\theta)*S_a(\theta)$$

where * represents a convolution, $S_e(\theta)$ is the antenna element's radiation pattern, $S_a(\theta)$ is the array factor, and $\theta$ is an elevation angle of the antenna array (as described with respect to FIG. 7B).

Each antenna element's radiation pattern is based on properties relating to the antenna element's construction/composition, such as antenna element type (e.g., patch, dipole, slot, etc.), material(s) used to construct the antenna element, and disposition of the antenna element in the antenna array. In this regard, antenna element type, antenna element material(s), and/or disposition associated with the antenna elements may be selected to generate a desired radiation pattern of each antenna element and, in combination, a desired radiation pattern of the antenna array.

The array factor is based on the positions of the antenna elements and a weight applied to each antenna element. The weight associated with the antenna element may be referred to as an electrical weight or a complex electrical weight, and may include a gain and/or phase shift associated with the antenna element. The array factor may be given by $$S_a(\theta)=\Sigma_{i=1}^{N}W_i e^{i\beta X_i \sin(\theta)}$$

where $\beta=2\pi/\lambda$, $\Sigma_{i=1}^{N}|W_i|=1$, N is the number of antenna elements, $\beta$ is the free-space wavenumber, $\lambda$ is the wavelength of signals transmitted or received by the antenna element, $X_i$ is the position of an $i^{th}$ antenna element of the antenna array along an array axis (as described with respect to FIG. 7B), and $W_i$ is the complex weight (e.g., gain and phase) associated with the $i^{th}$ antenna element.

The foregoing description of the radiation pattern of the antenna arrays applies to a radiation pattern of a TX antenna array as well as a radiation pattern of an RX antenna array. In this regard, the radiation pattern of the TX antenna array and the RX antenna array may be given by $S_{TX}(\theta)=S_{e,TX}(\theta)*S_{a,TX}(\theta)$ and $S_{RX}(\theta)=S_{e,RX}(\theta)*S_{a,RX}(\theta)$, respectively, where $S_{e,TX}(\theta)$ may be different from $S_{e,RX}(\theta)$ and/or $S_{a,TX}(\theta)$ may be different from $S_{a,RX}(\theta)$. The antenna system radiation pattern is a combination of the radiation patterns of the TX antenna array and the RX antenna array and is given by $$S_{system}(\theta)=S_{TX}(\theta)*S_{RX}(\theta)$$

where * represents a convolution.

In one or more embodiments, the subject system generates antenna parameters to effectuate (e.g., at least meet) characteristics of the desired radiation pattern of an antenna system, where the antenna system includes a TX antenna array and an RX antenna array. Radiation patterns of the TX antenna array and the RX antenna array can be considered antenna parameters to be appropriately adjusted to effectuate the desired antenna system radiation pattern. In this regard, rather than determining TX radiation patterns and the RX radiation patterns independent of one another based on transmission characteristics and reception characteristics, respectively, the TX and RX radiation patterns are to be determined with respect to characteristics of the antenna system radiation pattern.

The subject system may determine TX and RX radiation patterns based on a set of TX and RX antenna parameters, respectively; determine the antenna system radiation pattern based on the TX and RX radiation patterns; compare the determined antenna system radiation pattern to a reference (e.g., desired) antenna system radiation pattern; and adjust the TX and/or RX antenna parameters based on the comparison. The adjusted TX and/or RX antenna parameters may be used to generate adjusted TX and/or RX radiation patterns, which in turn may be used to generate an adjusted antenna system radiation pattern to be compared to the reference antenna system radiation pattern.

In an aspect, such an iterative process may be performed until the obtained antenna system radiation pattern has characteristics that conform to the reference antenna system radiation pattern. The reference system radiation pattern may be defined to exhibit application-dependent characteristics, such as location and/or gain of the main lobe, back lobe, side lobes, and/or nulls; half-power beamwidth; first null beamwidth; and/or other application-dependent characteristics. In some cases, antenna design specifications may provide the reference system radiation pattern. In other cases, antenna design specifications may provide desired characteristics to be exhibited by the reference system radiation pattern, with the reference system radiation pattern being determined based on the desired characteristics.

To reduce the number of variables in the antenna system design, constraints may be placed on the variables. For instance, the antenna element type and/or material may be constrained to those antenna element types and/or materials that are cost efficient and readily available from vendors, with the type and/or material decided early on in the antenna system design. In this regard, in one or more aspects, most of the iterations in the antenna system design may involve making adjustments to the gain, phase shift, and/or position associated with the antenna elements, e.g. rather than antenna element type and material.

Using the various embodiments, the conjoint beam shaping may allow antenna parameters to be generated to implement TX antenna array and RX antenna array that effectuate the antenna system radiation pattern. In this regard, the antenna system is designed (e.g., with antenna parameters) such that its antenna system radiation pattern has characteristics that satisfy a desired radiation pattern. The desired radiation pattern is based on design specifications and may be referred to as a reference radiation pattern, e.g. since the desired radiation pattern is compared with an antenna system radiation pattern implemented by a set of antenna elements. In an aspect, by conjointly shaping beams of the TX antenna array and the RX antenna array to obtain the radiation pattern of the antenna system, the radiation pattern of the TX antenna array may be utilized to compensate for the radiation pattern of the RX antenna array, and vice versa. For example, peaks and dips (e.g., troughs, valleys) in the radiation pattern of the RX antenna array may be compensated for by peaks and dips of the radiation pattern of the TX antenna array, and vice versa. The local or global minima/maxima (e.g., peaks and dips) may be based on the positions and disposition of the antenna elements in the TX and RX antenna arrays.

In one or more embodiments, by conjointly shaping beams, the subject system may allow improved detection capabilities by increasing a detection volume. Such detection capabilities may be utilized in object detection/ranging systems, such as in radar systems (e.g., object detection through use of electromagnetic (EM) waves) and sonar systems (e.g., detection through use of mechanical waves). For example, in a radar system, the radar system may be, may include, or may be a part of, an antenna system that includes a TX device and an RX device. The TX device may transmit EM radiation. An object may be detected when the object reflects the EM radiation emitted by the TX device and at least a portion of the reflected EM radiation is received by the RX device, which generally occurs when the object falls within the detection volume of the radar system. The reflected EM radiation serves as feedback associated with the emitted EM radiation. The emitted EM radiation and reflected EM radiation have the same wavelength λ. The detection volume of the radar system may include a volume within which reflections resulting from detected objects may be received by the RX device with sufficient signal power. In this regard, objects that fall outside of the detection volume may be associated with EM radiation received with power that is too low to be used for reliable detection. In some cases, position, shape, and/or other information about the detected objects can be determined by the reflected energy, time between transmitting EM radiation and receiving feedback EM radiation, and/or other characteristics. The feedback EM radiation received by the RX device when only a background scene is present may be used as a baseline for detecting objects.

The TX device and RX device may be collocated, or physically separate. In an aspect, a duplexer may switch between the TX device and the RX device, such that only antenna elements of the TX device or only antenna elements of the RX device are used at a given moment in time. In some cases, this switching may be utilized to prevent higher-power pulses generally associated with the TX device to adversely affect the RX device. In an aspect, the TX device and the RX device may be, may include, may be a part of, and/or may be referred to as, a TX circuit and an RX circuit, respectively.

In an aspect, the use of the radiation pattern of the TX antenna array to compensate the radiation pattern of the RX antenna array, and vice versa, may increase the detection volume, e.g. relative to a case in which the radiation pattern of the TX antenna array is determined (e.g., optimized) independent of the radiation pattern of the RX antenna array. For example, for radar systems, the antenna system radiation pattern may provide a detection volume that allows detection of objects at flight altitude, such as unmanned aerial vehicles (UAVs) at around 400 ft, as well as detection of objects at or near ground level, such as a human. The detection volume may be a volume in which the system detection power is sufficient to detect objects. In other words, objects that fall within the detection volume of the system can be reliably detected. At angles where antenna system gain is high (e.g., high TX and high RX gain), detection distance may be longer, and where the antenna system gain is low (e.g., low TX and/or low RX gain), detection distance may be shorter.

In an aspect, the detection volume may be generated from a maximum detection distance at each elevation angle (or azimuth angle, depending on an antenna array's orientation). The power $P_e$ received at a ranging system (e.g., radar or sonar system) based on a reflection, by an object, of a power $P_s$ of EM radiation of wavelength 2 transmitted by the ranging system is given by $$P_e = \frac{P_s G_{TX} G_{RX} \sigma \lambda^2}{(4\pi)^3 R^4}$$

where R is a detection distance (or detection range), $G_{TX}$ is the TX antenna gain, $G_{RX}$ is the RX antenna gain, and σ is the radar/sonar cross section of the object. As evident from the equation, a maximum detection distance is a function of the TX and RX antenna gain, transmitted and received signal power and associated signal wavelength, and properties (e.g., size, shape, material) of the object itself. For example, if a radar detects a particular object at 1,000 meters at an angle where the total gain is 17 dB (50.12 on linear scale), then the detection distance for the same object at another angle where the total gain is 24 dB (251.19 on linear scale) is equal to around 1,500 meters (i.e., (1000×(251.19/50.12)¼).

In some cases, the antenna elements of the TX antenna array are designated for transmitting signals and the antenna elements of the RX antenna array are designated for receiving signals. In other words, the antenna elements that form the TX antenna array and the antenna elements that form the RX antenna array are disjoint (e.g., have no elements in common). In other cases, some of the antenna elements in the TX antenna array may also be utilized by the RX antenna array, and vice versa. For example, an antenna element of the TX antenna array may be used to transmit a signal at a moment in time, and the same antenna element of the TX antenna array may be used to receive a signal at another moment in time. The antenna element may transmit or receive signals in a time multiplexed manner.

In some aspects, an antenna system may include multiple TX antenna arrays and/or multiple RX antenna arrays. Each TX and RX antenna array pair may be configured with radiation patterns to facilitate transmission and reception of signals from different directions. In this regard, each TX and RX antenna array pair may be associated with a respective antenna system radiation pattern implemented by respective TX and RX antenna parameters. In some cases, multiple TX antenna arrays may share a single RX antenna array (or vice versa), e.g. with the RX antenna array being configured differently depending on which TX antenna array it is currently paired with.

Although the present disclosure is generally described with reference to antennas and antenna arrays for transmitting and/or receiving EM waves, one or more embodiments may also apply to antennas and antenna arrays for transmitting and/or receiving mechanical waves, such as sound waves. Such embodiments may be utilized, for instance, in sonar applications.

FIG. 1 illustrates an example environment 100 in which conjoint beam shaping may be implemented in accordance with one or more embodiments of the present disclosure. Not all of the depicted components may be required, however, and one or more embodiments may include additional components not shown in FIG. 1. Variations in the arrangement and type of the components may be made without departing from the spirit or scope of the claims as set forth herein. Additional, fewer, and/or different components may be provided.

The example environment 100 includes a ranging system 105 and objects 110, 115, and 120 within a detection volume of the ranging system 105. The ranging system 105 may include a TX device for transmitting EM radiation and an RX device for receiving EM radiation. In this regard, the TX device may transmit EM radiation 125. The objects 110, 115, and 120 may reflect at least a portion of the EM radiation 125 as reflected EM radiation 130, 135, and 140, respectively. At least a portion of the reflected EM radiation 130, 135, and 140 is received by the RX device of the ranging system 105. By way of non-limiting example, as depicted in FIG. 1, the objects 110, 115, and 120 include a UAV, a human, and a vehicle, respectively. In general, an object may refer to any person or thing that may be detected by the ranging system 105 when in range of the ranging system 105. In some aspects, such as shown in FIG. 1, the detection volume of the ranging system 105 encompasses objects at flight altitudes (e.g., the object 110) and objects at or near ground level (e.g., the objects 115 and 120).

Although the environment 100 provides one example of an environment in which conjoint beam shaping may be implemented, other environments may include additional ranging systems (e.g., multiple ranging systems operating independently or in tandem) and/or more or fewer objects than those shown in the environment 100. For instance, in an environment with multiple ranging systems, the ranging systems may communicate with each other via one or more wireless technologies such as Wi-Fi (IEEE 802.11ac, 802.11 lad, etc.), cellular (3G, 4G, 5G, etc.), infrared-based communication, optical-based communications, proprietary wireless communications, and/or other appropriate wireless communication standards and/or protocols and/or one or more wired communication technologies.

Figure 2:
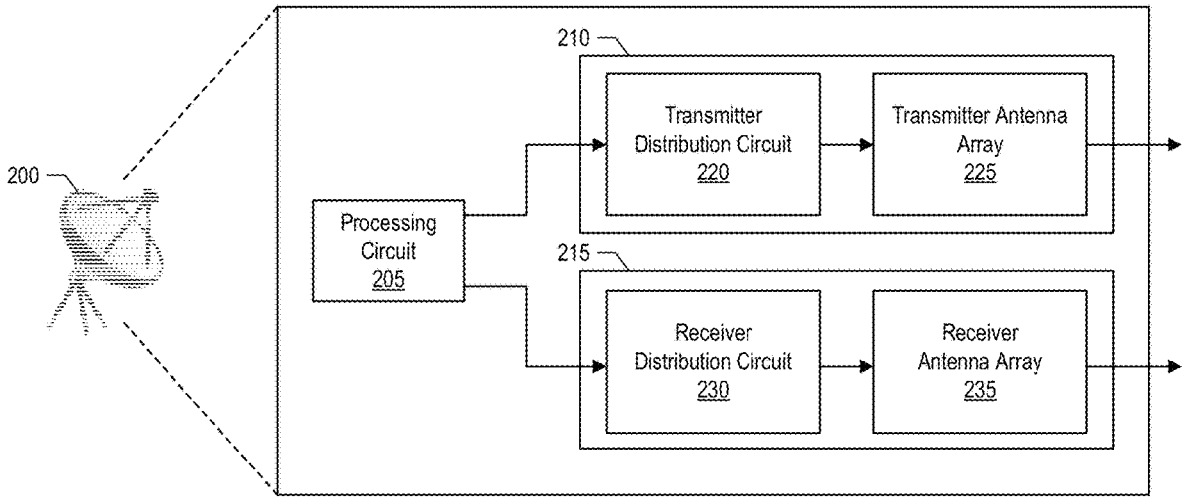
FIG. 2 illustrates an example of an antenna system implementing conjoint beam shaping in accordance with one or more embodiments of the present disclosure.

FIG. 2 illustrates an example of an antenna system 200 implementing conjoint beam shaping in accordance with one or more embodiments of the present disclosure. Not all of the depicted components may be required, however, and one or more embodiments may include additional components not shown in FIG. 2. Variations in the arrangement and type of the components may be made without departing from the spirit or scope of the claims as set forth herein. Additional, fewer, and/or different components may be provided. In an embodiment, the antenna system 200 may be, may include, or may be a part of, the radar system 105 of FIG. 1. In an aspect, the antenna system 200 may be, may include, or may be a part of, an electronic system described with respect to FIG. 8.

The antenna system 200 includes a processing circuit 205, a TX device 210, and an RX device 215. The TX device 210 includes a TX distribution circuit 220 and a TX antenna array 225. The RX device 215 includes an RX distribution circuit 230 and an RX antenna array 235. The TX antenna array 225 and the receiver antenna array 235 may each include a number of antenna elements. The number of antenna elements in the TX antenna array 225 may be the same, or may be different from the number of antenna elements in the RX antenna array 235.

Connections between the various components (e.g., the processing circuit 205, TX device 210, RX device 215) shown in FIG. 2 may be wired and/or wireless connections. In some cases, the connections may include intra-chip, inter-chip (e.g., within the same device or between different devices), and/or inter-device connections. For example, although the antenna system 200 is depicted in FIG. 2 as having a single housing containing the various components, the components of the antenna system 200 may be separated across multiple housings and connected (e.g., wire connected, wirelessly connected) with one another. For example, the TX device 210 and the RX device 215 (and/or components thereof) may be physically distributed within one housing or across multiple housings. In some cases, the processing circuit 205 may be integrated on the same integrated circuit or on separate integrated circuits from the TX device 210 and/or RX device 215. For example, the processing circuit 205 may be connected to the TX device 210 and/or RX device 215 via intra-chip connections (e.g., traces). Additional, fewer, and/or different connections may be provided.

The processing circuit 205 may communicate control information for the TX device 210 and RX device 215. In this regard, the processing circuit 205 may generate and transmit control signals that contain control information to the TX device 210 and the RX device 215. The control information may be, or may be utilized to derive, antenna parameters to be utilized for the antenna elements of the TX antenna array 225 and RX antenna array 235. For example, the antenna parameters may include the antenna coefficients that indicate phase shift and/or gain to be applied to the antenna elements of the TX antenna array 225 and RX antenna array 235. In cases in which a position of at least some of the antenna elements may be movable, the antenna parameters may include a position to place the antenna elements. In some cases, the control information may turn on or off an antenna element, such that the antenna element is not used for transmission and/or reception. For instance, in an aspect, one way to turn off an antenna element is to set the gain of the antenna element to zero. It is noted that the applied gain may include unity gain (e.g., no applied gain), zero gain (e.g., nulled signal), negative gain (e.g., inverted signal), attenuation (e.g., gain between 0 and 1), or amplification (e.g., gain above 1).

In some cases, the processing circuit 205 may generate the antenna parameters to be utilized. For example, the processing circuit 205 may generate the antenna parameters based on an antenna system radiation pattern, a TX radiation pattern, and/or an RX radiation pattern to be exhibited. In other cases, the processing circuit 205 may receive the antenna parameters (e.g., from another device) and generate/transmit control signals with the antenna parameters to the TX device 210 and RX device 215.

The TX distribution circuit 220 may configure the antenna elements of the TX antenna array 225 using TX antenna parameters. The TX distribution circuit 220 may include phase shifters and/or amplifiers (e.g., power amplifiers) to effectuate (e.g., distribute) antenna parameters. In an aspect, amplifiers may include, or may refer to, passive components that provide unity gain or less than unity gain. The TX distribution circuit 220 may receive the TX antenna parameters from the processing circuit 205 and/or derive the TX antenna parameters based on information received from the processing circuit 205. In some cases, the TX distribution circuit 220 may also configure the positions of the antenna elements of the TX antenna array 225. Thus, in an aspect, the TX antenna parameters may provide antenna coefficients (e.g., gain and/or phase shift) and/or position of each antenna element.

In some cases, each antenna element may be associated with a phase shifter and an amplifier, with the phase shifter and amplifier configured based on the antenna coefficients associated with the antenna element. In other cases, the phase shifters and/or amplifiers may be shared by the antenna elements of the TX antenna array 225 and programmed as appropriate (e.g., in a time-multiplexed manner) to effectuate the phase shift and/or gain to be applied. The sharing of the phase shifters, amplifiers, and/or other components may be effectuated through use of clock signals, switching devices, and/or other associated logic/circuitry for facilitating time synchronization.

The RX distribution circuit 230 may configure the antenna elements of the RX antenna array 235. The RX distribution circuit 230 may include phase shifters and/or amplifiers (e.g., low noise amplifiers) to effectuate antenna parameters. The RX distribution circuit 230 may receive the antenna parameters from the processing circuit 205 and/or derive the antenna parameters based on information received from the processing circuit 205. The phase shifters and/or amplifiers may be dedicated to an antenna element, or may be shared by multiple antenna elements of the RX antenna array 235 and programmed as appropriate to effectuate the phase shift and/or gain to be applied. In some cases, the RX distribution circuit 230 may also configure the positions of the antenna elements of the RX antenna array 235. Thus, in an aspect, the RX antenna parameters may provide antenna coefficients (e.g., gain and/or phase shift) and/or position of each antenna element.

In this regard, each antenna element of the TX antenna array 225 and RX antenna array 235 may be associated with a respective set of parameters. For an individual antenna element, the parameters may include a position of the antenna element in the antenna array and a gain and/or phase shift to associate with (e.g., to be applied to signals received by or to be transmitted by) the antenna element. In some cases, the gain and/or phase shift are provided by antenna coefficients associated with the antenna element.

In an aspect, in the transmit direction, the processing circuit 205 may provide a signal to the TX device 210 to be transmitted. The TX distribution circuit 220 may convert (e.g., upconvert) the signal to a frequency suitable for transmission (e.g., radio frequency) and apply phase shift and/or gain to the converted signal to form a signal to be transmitted via the TX antenna array 225. In some cases, rather than include one or more mixer circuits in the TX distribution circuit 220 to perform the conversion, the mixer circuit(s) may be included in the processing circuit 205 and/or between the processing circuit 205 and the TX distribution circuit 220.

In an aspect, in the receive direction, the RX antenna array 235 receives signals via its antenna elements. The RX distribution circuit 230 applies phase shifts and/or gain to signals received via the antenna elements, converts (e.g., downconverts) the signal to facilitate processing by the processing circuit 205, and transmits the converted signal to the processing circuit 205. In some cases, rather than include one or more mixer circuits in the RX distribution circuit 230 to perform the conversion, the mixer circuit(s) may be included in the processing circuit 205 and/or between the processing circuit 205 and the RX distribution circuit 230.

The radiation pattern of the antenna system 200 is based on a combination of the TX radiation pattern of the TX device 210 and the RX radiation pattern of the RX device 215. In various embodiments, the TX antenna parameters utilized by the TX device 210 and the RX antenna parameters utilized by the RX device 215 may be conjointly determined to effectuate a desired radiation pattern of the antenna system 200. In an aspect, the antenna system 200 may be utilized for radar applications, e.g. transmit a signal using the TX device 210 and receive a reflection of the transmitted signal by one or more objects using the RX device 215.

Although the antenna system 200 of FIG. 2 illustrates an example of an antenna system with a single TX antenna array (e.g., 225) and a single RX antenna array (e.g., 235), an antenna system may have multiple TX antenna arrays (and associated TX distribution circuits) and/or multiple RX antenna arrays (and associated RX distribution circuits). For example, different TX and RX antenna arrays may be utilized to facilitate transmission and reception of signals in different directions. In this example, multiple beams may be transmitted and received via different TX and RX antenna arrays of the antenna system. In some aspects, conjoint beam shaping may be utilized for at least some of the one or more TX and RX antenna array pairs (e.g., one pair being the TX antenna array 225 and RX antenna array 235).

In an aspect, the number of antenna elements in each of the TX antenna array 225 and the RX antenna array 235 may be eight antenna elements or more. For instance, in some cases, the number of antenna elements in each of the TX antenna array 225 and the RX antenna array 235 may be in the hundreds or thousands.

Figure 3:
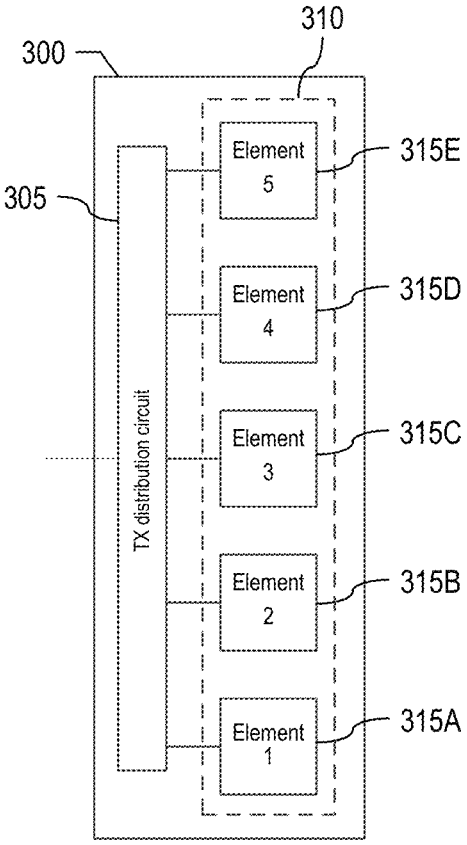
FIG. 3 illustrates an example of a transmitter device in accordance with one or more embodiments of the present disclosure.

FIG. 3 illustrates an example of a TX device 300 in accordance with one or more embodiments of the present disclosure. The TX device 300 includes a TX distribution circuit 305 and a TX antenna array 310. The TX antenna array 310 includes antenna elements 315A-E. Thus, the number of antenna elements, denoted by N, is 5. In an embodiment, the TX device 300 may be, may include, or may be a part of the TX device 210 shown in FIG. 2.

Figure 4:
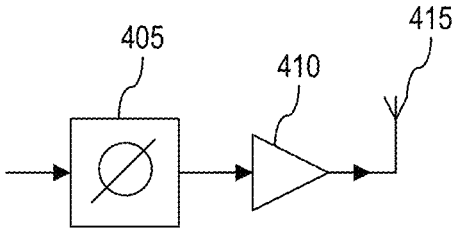
FIG. 4 illustrates an example of a phase shift and gain applied to a transmit antenna element in accordance with one or more embodiments of the present disclosure.

FIG. 4 illustrates an example of a phase shift and gain applied to an antenna element 415 in accordance with one or more embodiments of the present disclosure. A phase shifter 405 and an amplifier 410 (e.g., a power amplifier) may be part of a TX distribution circuit. The phase shifter 405 may receive a signal (e.g., a signal converted to radio frequency) and apply phase shift to the signal. The amplifier 410 may apply gain to the phase shifted signal. An output of the amplifier 410 is provided to the antenna element 415 for transmission by the antenna element 415. In an embodiment, the phase shifter 405 and the amplifier 410 may form part of the TX distribution circuit 305 of FIG. 3. In some cases, the phase shifter 405 and/or the amplifier 410 may be utilized to apply phase shift and/or gain to multiple antenna elements (e.g., in a time-multiplexed manner). In some cases, a relative gain and/or phase shift may be distributed to each antenna element using a passive distribution network, rather than an active distribution network. For instance, the TX distribution circuit may include, or may be a part of, a passive distribution network for providing relative gain and/or phase shift to each antenna element.

Figure 5:
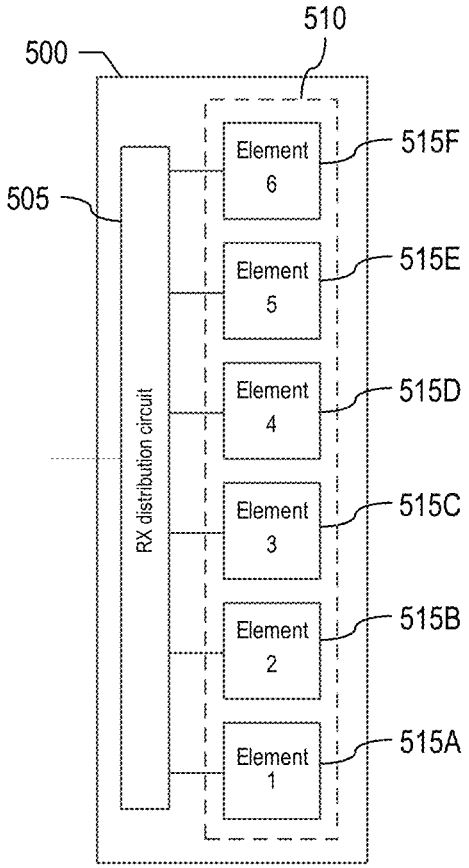
FIG. 5 illustrates an example of a receiver device in accordance with one or more embodiments of the present disclosure.

FIG. 5 illustrates an example of an RX device 500 in accordance with one or more embodiments of the present disclosure. The RX device 500 includes an RX distribution circuit 505 and an RX antenna array 510. The RX antenna array 510 includes antenna elements 515A-F. Thus, the number of antenna elements is 6. In an embodiment, the RX device 500 may be, may include, or may be a part of the RX device 215 shown in FIG. 2.

Figure 6:
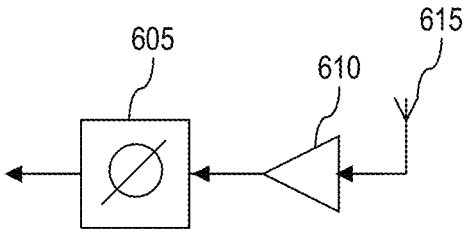
FIG. 6 illustrates an example of a phase shift and gain applied to a receive antenna element in accordance with one or more embodiments of the present disclosure.

FIG. 6 illustrates an example of a phase shift and gain applied to an antenna element 615 in accordance with one or more embodiments of the present disclosure. A phase shifter 605 and an amplifier 610 (e.g., a low noise amplifier) may be part of an RX distribution circuit. The antenna element 615 receives a signal (e.g., a radio frequency signal). The amplifier 610 (e.g., a low noise amplifier) applies gain to the received signal, and the phase shifter 605 applies a phase shift. In an embodiment, the phase shifter 605 and the amplifier 610 may form part of the RX distribution circuit 505 of FIG. 5. In some cases, the phase shifter 605 and/or the amplifier 610 may be utilized to apply phase shift and/or gain to multiple antenna elements (e.g., in a time-multiplexed manner). In some cases, a relative gain and/or phase shift may be distributed to each antenna element using a passive distribution network, rather than an active distribution network. For instance, the RX distribution circuit may include, or may be a part of, a passive distribution network for providing relative gain and/or phase shift to each antenna element.

Although the TX antenna array 310 and RX antenna array 510 are linear antenna arrays, antenna arrays may be arranged in other forms, such as a two-dimensional array of antenna elements. Further, not all of the depicted components may be required, however, and one or more embodiments may include additional components not shown in FIG. 3-6. Variations in the 10*o* arrangement and type of the components may be made without departing from the spirit or scope of the claims as set forth herein. Additional, fewer, and/or different components may be provided. As an example, FIGS. 3 and 5 may have additional or fewer antenna elements. As another example, FIGS. 4 and 6 may include one or more switches and/or control elements coupled to the various components (e.g., to effectuate time-based sharing of the various components).

FIGS. 7A and 7B illustrate a front view and a side view of the TX antenna array 310 shown in FIG. 3, in accordance with one or more embodiments of the present disclosure. In FIG. 7A, the X-axis is provided in terms of A, which is the wavelength of signals transmitted by the TX antenna array 310. In this regard, in FIG. 7A, the antenna elements 315A-E are arranged along the X-axis, with adjacent antenna elements being 0.752 away from each other. An origin (e.g., a reference point) of the X-axis is set at the position of the antenna element 315C. In FIG. 7B, a ray r provides a distance of a point ($Y_1$, $X_1$) from the origin (set at the antenna element 315C) and an angle θ provides an angular rotation from the ray r to the Y-axis. In an aspect, the angle θ may be referred to as an elevation or azimuth angle, depending on the array's orientation. In an aspect, the RX antenna array 510 shown in FIG. 5 has a similar front view and side view as those shown in FIGS. 7A and 7B, respectively. The antenna parameters associated with each of the antenna elements 315A-E include a position of each antenna element (e.g., relative to the position of other antenna elements), a gain associated with each antenna element, and/or a phase shift associated with each antenna element. It is noted that the RX antenna array 510 may have a front view and a side view similar to that shown in FIGS. 7A and 7B, respectively.

Adjacent (or neighboring) antenna elements of an antenna array may refer to antenna elements that are closest to one another. For example, in FIG. 3, the antenna elements 315A-E of the TX antenna array 310 are provided in a line. The antenna element 315E is adjacent to the antenna element 315D, the antenna element 315D is adjacent to the antenna elements 315C and 315E, the antenna element 315C is adjacent to the antenna elements 315B and 315D, the antenna element 315A is adjacent to the antenna element 315B, and so forth. In an aspect, the spacing between adjacent antenna elements may be within around 0.52 and around 1.02.

Figure 8:
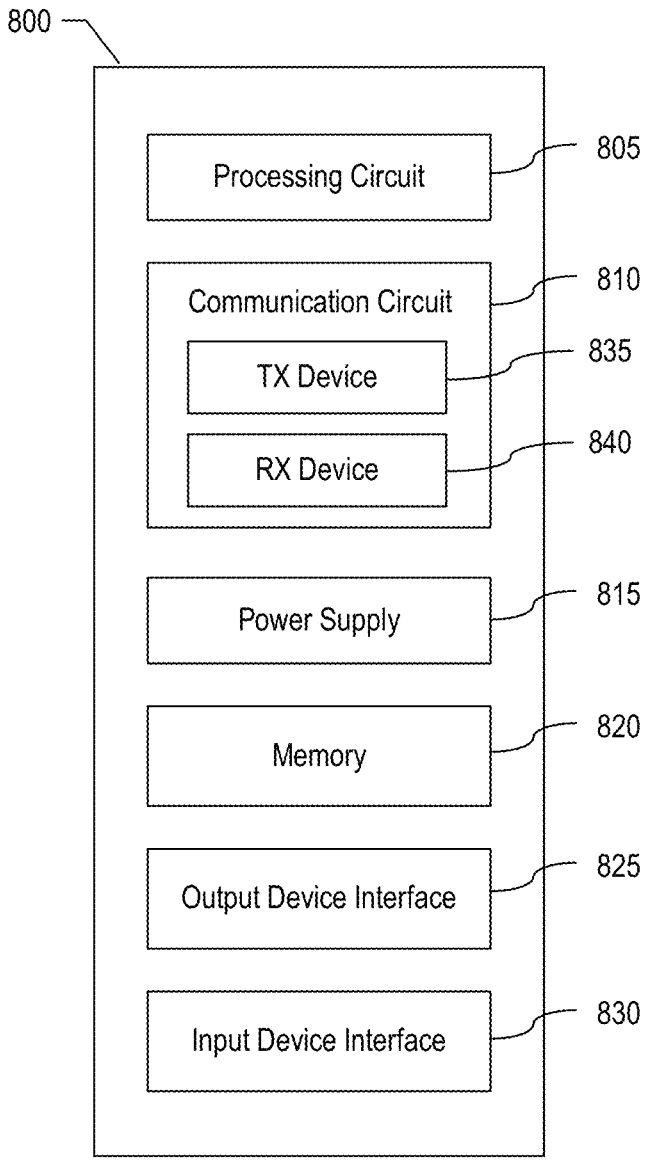
FIG. 8 illustrates a block diagram of an example device in accordance with one or more embodiments of the present disclosure.

FIG. 8 illustrates a block diagram of an example device 800 in accordance with one or more embodiments of the present disclosure. Not all of the depicted components may be required, however, and one or more embodiments may include additional components not shown in the figure. Variations in the arrangement and type of the components may be made without departing from the spirit or scope of the claims as set forth herein. Additional components, different components, and/or fewer components may be provided.

The device 800 includes a processing circuit 805, communication circuit 810, power supply 815, memory 820, output device interface 825, and input device interface 830. The processing circuit 805 may be configured to generate TX and RX antenna parameters to be utilized to physically construct and/or configure a TX antenna array and an RX antenna array of an antenna system. For example, the processing circuit 805 may generate the TX and RX antenna parameters to be utilized based on an iterative process, in which TX and RX antenna parameters are adjusted as appropriate to effectuate a desired antenna system radiation pattern. By way of non-limiting example, the antenna parameters may include a number of antenna elements to be used in the TX antenna array, a number of antenna elements to be used in the RX antenna array, a position of each of the antenna elements, material properties of each of the antenna elements, gain to be applied to each of the antenna elements (e.g., via an amplifier and/or passive circuitry), phase shift to be applied to each of the antenna elements (e.g., via a phase shifter), and/or other antenna parameters. To reduce computational complexity, some antenna parameters may be fixed (e.g., rather than variable). In this regard, the number of degrees of freedom may be, or may be indicative of, the number of individual parameters that can be adjusted to influence a system beam shape or component thereof (e.g., TX antenna pattern, RX antenna pattern).

The communication circuit 810 may be configured to handle, manage, or otherwise facilitate wired and/or wireless communication between various components of the device 800 and between the device 800 and another device. The communication circuit 810 includes a TX device 835 and an RX device 840. For example, the communication circuit 810 may be utilized to transmit the TX and RX antenna parameters to another device, such as the antenna system 200 to allow construction and/or configuration of the TX device 210 and the RX device 215. Alternatively or in addition, the TX device 835 and the RX device 840 may be configured with antenna parameters that are determined conjointly. In an aspect, the communication circuit 810 may be utilized for radar applications, e.g. transmit a signal using the TX device 835 and receive a reflection of the transmitted signal by one or more objects using the RX device 840.

In an embodiment, the communication circuit 810 may include a wireless communication circuit (e.g., based on the IEEE 802.11 standard, Bluetooth™ standard, ZigBee™ standard, or other wireless communication standard), cellular circuit, or other appropriate communication circuit. In some cases, the communication circuit 810 may be configured for a proprietary wireless communication protocol and interface. The communication circuit 810 may include, or may be in communication with, an antenna for wireless communication. Thus, in one embodiment, the communication circuit 810 may handle, manage, or otherwise facilitate wireless communication by establishing a wireless link to a handheld device, base station, wireless router, hub, or other wireless networking device.

The communication circuit 810 may be configured to interface with a wired network, such as via an Ethernet interface, power-line modem, Digital Subscriber Line (DSL) modem, Public Switched Telephone Network (PSTN) modem, cable modem, and/or other appropriate components for wired communication. Alternatively or in addition, the communication circuit 810 may support proprietary wired communication protocols and interfaces. The communication circuit 810 may be configured to communicate over a wired link (e.g., through a network router, switch, hub, or other network device) for purposes of wired communication. A wired link may be implemented with a power-line cable, coaxial cable, fiber-optic cable, or other cable or wires that support corresponding wired network technologies.

The power supply 815 may supply power to operate the device 800, such as by supplying power to the various components of the device 800. An amount of power supplied via the power supply 815 may be adjusted based on different operation modes of the device 800 (e.g., standby mode, normal power mode). The power supply 815 may be, or may include, one or more batteries (e.g., rechargeable batteries, non-rechargeable batteries). The batteries may be a lithium ion battery, lithium polymer battery, nickel cadmium battery, nickel metal hydride battery, or any other battery suitable to supply power to operate the device 800. Alternatively or in addition, the power supply 815 may be, or may include, one or more solar cells. The solar cells may be utilized to supply power to operate the device 800 and/or to charge one or more rechargeable batteries.

The memory 820 may be utilized to store information for facilitating operation of the device 800. By way of non-limiting example, the memory 820 may include non-volatile memory, such as read-only memory (ROM), programmable ROM (PROM), erasable programmable ROM (EPROM), electrically erasable programmable (EEPROM), flash, non-volatile random-access memory (NVRAM), etc. The memory 820 may include volatile memory, such as random-access memory (RAM), dynamic RAM (DRAM), static RAM (SRAM), etc. The memory 820 may store information such as instructions to be executed by the various components (e.g., the processing circuit 805) of the device 800, antenna parameters, and/or other information. In an embodiment, a process 900 (described with respect to FIG. 9) may be provided as instructions stored in the memory 820 and/or other memory included in the device 800 and/or otherwise accessible to the device 800. For example, the instructions may be stored in volatile memory and/or non-volatile memory of the device 800, and/or on a removable memory accessible to the device 800.

The output device interface 825 may allow the device 800 to communicate information to a user (e.g., an operator of the device 800). An output device may be included in the device 800 or otherwise connected to the device 800 via the output device interface 825. The output device may include a display device, such as a screen, touchscreen, and/or monitor, to display, or display information associated with, antenna parameters; TX, RX, and system antenna patterns; and/or simulation results. In some cases, the output device may be utilized to display a user interface to request user input/feedback. For example, the output device may display a prompt to the user to confirm whether to proceed with a set of TX, RX, and/or antenna system radiation patterns; manually set one or more antenna parameters and/or threshold values (e.g., a threshold score); and/or other prompts for user input/feedback.

The input device interface 830 may allow the user to communicate information to the device 800. Input devices that may be used with the input device interface 830 may include, for example, alphanumeric keyboards and pointing devices. An input device may be included in the device 800 or otherwise connected to the device 800 via the input device interface 830. In some cases, the input device may be a virtual keyboard provided for display using an output device (e.g., connected to the output device interface 825). In some cases, the input device interface 830 may allow the device 800 to receive a user input in response to a prompt displayed to the user.

In an embodiment, the TX antenna parameters and the RX antenna parameters may be provided to the antenna system 200 of FIG. 2 to be used to physically construct and/or configure the TX device 210 and the RX device 215. In this embodiment, some antenna parameters may be utilized to implement the TX antenna array 225 and the RX antenna array 235, such as the positions of the antenna elements, whereas other antenna parameters may be utilized to implement the TX distribution circuit 220 and the RX distribution circuit 230, such as the gain and phase shift to be applied by the amplifiers (and/or passive circuitry) and phase shifters of the TX distribution circuit 220 and the RX distribution circuit 230.

In another embodiment, the device 800 may be, may include, or may be a part of, the antenna system 200. In such a case, the processing circuit 805 may generate the TX and RX antenna parameters to configure the communication circuit 810. The communication circuit 810 may include the TX device 210 and the RX device 215, e.g. the TX device 835 and the RX device 840 may be, may include, or may be a part of, the TX device 210 and the RX device 215, respectively.

Figure 9:
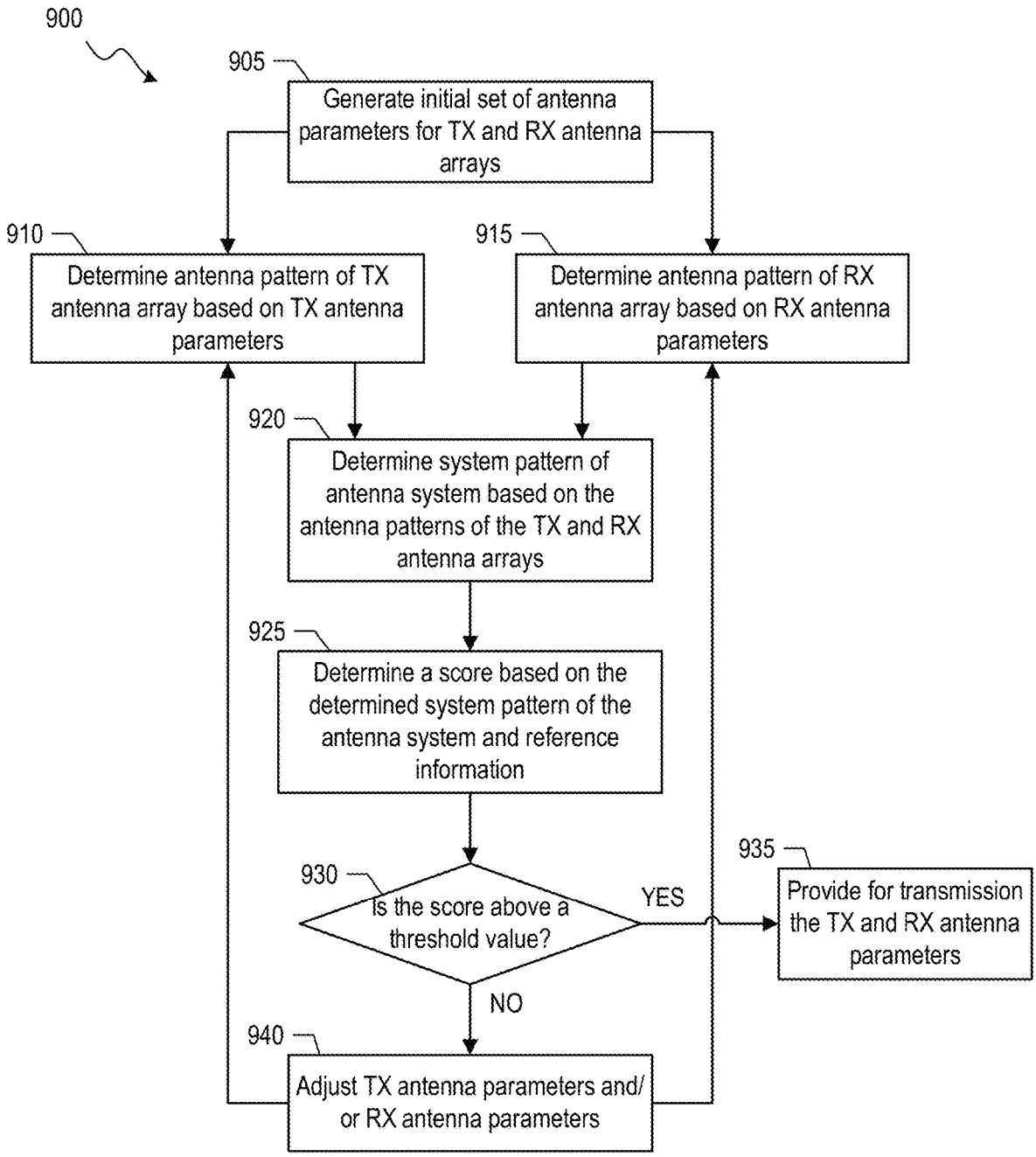
FIG. 9 illustrates a flow diagram of an example process for facilitating conjoint beam shaping in accordance with one or more embodiments of the present disclosure.

FIG. 9 illustrates a flow diagram of an example process 900 for facilitating conjoint beam shaping in accordance with one or more embodiments of the present disclosure. For explanatory purposes, the example process 900 is primarily described herein with reference to the antenna system 200 and device 800 of FIGS. 2 and 8, respectively; however, the example process 900 is not limited to the antenna system 200 and device 800 of FIGS. 2 and 8. In this regard, for explanatory purposes, the device 800 generates TX and RX antenna parameters to be utilized to implement (e.g., construct, configure gain/phase) the TX device 210 and RX device 215 of the antenna system 200. Further, for explanatory purposes, the blocks of the example process 900 are described herein as occurring in serial, or linearly. However, multiple blocks of the example process 900 may occur in parallel. In addition, the blocks of the example process 900 need not be performed in the order shown and/or one or more of the blocks of the example process 900 need not be performed.

At block 905, the device 800 determines an initial set of parameters for the TX antenna array 225 and the RX antenna array 235. The parameters may include, for instance, a complex weight (e.g., gain and phase shift) of the antenna elements and a position of the antenna elements in the antenna arrays 225 and 235. In some cases, one or more antenna elements of the TX antenna array 225 and/or RX antenna array 235 may be turned off, e.g. not utilized for transmission and/or reception. For instance, a zero gain may be associated with an antenna element that is turned off. As an example, with reference to FIGS. 3 and 5, N is 5 for the TX antenna array 225 and 6 for the RX antenna array 235. As another example, the number of antenna elements of the TX antenna array may be the same as the number of antenna elements of the RX antenna array.

The weight may be provided by, and/or may be referred to as, an antenna coefficient. In an aspect, the initial set of weights may be set to $W_i=1/N$, in which case N is the number of antenna elements of an antenna array and i is an identifier number associated with an antenna element (e.g., i=1, 2, . . . , N). Such an initial set of weights may be utilized when a peak antenna gain is desired at broadside. In an aspect, if a peak antenna gain is needed at an orientation other than broadside, an initial phase may be set to direct the peak antenna gain at the desired orientation. As an example, to direct a peak antenna gain at a 30° angle and with antenna elements spaced 0.8λ apart, an initial phase of an $i^{th}$ antenna element can be given by $\varphi_i=0.4\lambda i=0.8\pi i$.

In one case, a spacing between any two adjacent antenna elements may be set to be equidistant and initialized to λ/2 for the TX antenna array 225 and λ/2 for the RX antenna array 235, where λ is the wavelength associated with signals to be transmitted by the TX antenna array 225 and to be received by the RX antenna array 235. In such a case, the spacing between any two adjacent antenna elements may be provided by a single inter-element spacing for each of the TX antenna array 225 and the RX antenna array 235. In another case, the spacing between any two adjacent antenna elements is the same for the antenna elements of the TX antenna array 225 and is bound to a value within [0.5λ, 1.0λ]. In another case, the spacing between any two adjacent antenna elements may be, but need not be, different.

At block 910, the device 800 determines a TX antenna pattern of the TX antenna array 225 based on the TX antenna parameters. At block 915, the device 800 determines a receiving antenna pattern of the RX antenna array 235 based on the RX antenna patterns. In this regard, the TX and RX antenna parameters are the initial set of TX and RX antenna parameters, respectively, set at block 905. At block 920, the device 800 determines, based on the TX antenna pattern and the RX antenna pattern, an antenna pattern of an antenna system that includes the TX antenna array 225 and RX antenna array 235. In an aspect, the antenna pattern of the antenna system may be a combination (e.g., a convolution) of the TX antenna pattern and the RX antenna pattern.

At block 925, the device 800 determines a score based on the antenna system radiation pattern determined at block 920 and reference information. In an aspect, the reference information may be a reference radiation pattern, such as a desired antenna pattern set based on a design specification. In this aspect, the score may be indicative of (e.g., based on) a difference between the determined antenna pattern and the reference antenna pattern. Alternatively or in addition, the reference information may be one or more desired characteristics (e.g., from antenna design specifications/requirements). The score may be indicative of (e.g., based on) a difference between the desired characteristic(s) and a corresponding characteristic(s) associated with the antenna pattern determined at block 920. An example of a characteristic may be a directivity and associated direction, with the score being based on a difference between the directivity and associated direction, as provided by the antenna pattern determined at block 920, and the desired directivity and direction. Other examples of characteristics may include location and/or gain of the main lobe, back lobe, side lobes, and/or nulls; half-power beamwidth; first null beamwidth; and/or other application-dependent characteristics. The characteristics may be referred to as figures of merit.

In an aspect, the score may be based on an average (e.g., a weighted average) of multiple desired characteristics. In some cases, higher weights may be applied to higher priority characteristics. For example, in some applications, the directivity may be of higher priority than the first null beamwidth. In this example, a small difference between the directivity of the antenna pattern determined at block 920 and the desired directivity may affect the score more than a large difference between the first null beamwidth of the antenna pattern determined at block 920 and the desired first null beamwidth.

At block 930, the device 800 determines whether the score is above a threshold value.

When the device 800 determines that the score is above the threshold value, the device 800 provides for transmission the TX and RX antenna parameters utilized to generate the antenna system radiation pattern at block 935. In one case, the device 800 may transmit the TX and RX antenna patterns, e.g. to the antenna system 200 to allow the antenna system 200 to implement the TX device 210 and RX device 215. Alternatively or in addition, the device 800 may store the TX and RX antenna patterns (e.g., in memory local to or otherwise accessible to the device 800) to be transmitted at a later time by the device 800 and/or to allow the TX and RX antenna parameters to be retrieved by another device (e.g., the antenna system 200).

In an embodiment, once the score is above the threshold value, the TX antenna array 225 and the RX antenna array 235 may be formed using the TX antenna parameters and RX antenna parameters. For example, the TX antenna array 225 and the RX antenna array 235 may be formed by physically constructing the TX antenna array 225 and the RX antenna array 235. Alternatively or in addition, the TX antenna array 225 and the RX antenna array 235 may be formed by configuring the TX antenna array 225, e.g. to program the gain, phase shift, and/or position of the antenna elements of the TX antenna array 225 and the RX antenna array 235.

Although the foregoing is with reference to the score being greater than the threshold value, in which case higher scores are generally desired, other manners by which to define the score may be used. For instance, the score may be defined such that a score of a lower value is desired, such as when a lower value represents a difference between the desired antenna pattern and the determined antenna pattern being small.

When the antenna system 200 determines that the score is not above the threshold value, the TX antenna parameters and/or the RX antenna parameters are adjusted at block 940. In an aspect, the blocks 910, 915, 920, 925, 930, and/or 940 may be repeated until the score is above the threshold value. In another aspect, the blocks 910, 915, 920, 925, 930, and/or 940 may be repeated until the score is above the threshold value or until a threshold number of iterations is exceeded (e.g., signifying that the design of the antenna system is not converging to the desired antenna pattern). The TX and/or RX antenna parameters may be adjusted based on optimization methods including, by way of non-limiting example, steepest descent, conjugate gradients, simulated annealing, genetic algorithm, and/or other optimization methods such that the antenna pattern (and/or associated characteristic(s)) effectuated by the TX and RX antenna parameters converges toward the desired antenna pattern (and/or associated characteristic(s)). In some cases, to reduce the number of degrees of freedom, a subset of the TX antenna parameters and/or the RX antenna parameters may be adjusted, whereas other parameters may be fixed. For instance, the gain and/or phase shift of the antenna elements may be adjusted at block 940, whereas the number of antenna elements, position of the antenna elements, material properties of the antenna elements may be considered to be fixed (e.g., and not adjusted at block 940). Antenna parameters may be adjustable or considered to be fixed based on considerations such as component and/or design cost, component availability, component properties, and/or other considerations.

In an embodiment, processes for determining antenna parameters may be performed over multiple stages. For instance, in a first stage, the element factor's response for the TX device (e.g., the TX device 210) and the RX device (e.g., the RX device 215) may be assumed to be fixed and assumed to be the same for each antenna element, e.g. to reduce the number of variables that are adjusted to obtain a desired antenna system radiation pattern. In this first stage, a first set of types of antenna parameter, such as the positions and disposition, gain, and/or phase shifts of the antenna elements, may be adjusted. In this regard, blocks 910, 915, 920, 925, 930, and 940 may be performed until the score is above the threshold value.

Once the score associated with the first stage is above the threshold value, a second stage is entered. In the second stage, the element factor's response may be adjusted, while the antenna parameters determined during the first stage are fixed. In some cases, the element factor's response may be adjusted while still being the same across all antenna elements. In other cases, the element factor response of each antenna element may be adjusted individually, such that the antenna elements may have different element factor responses. Blocks 910, 915, 920, 925, 930, and 940 may be performed until a score associated with the second stage is above a threshold value. In some cases, the processes may transition back to the first stage from the second stage, such as if an antenna system radiation pattern (and/or associated characteristic(s)) is not converging to the reference radiation pattern (and/or associated characteristic(s)). In some cases, more than two stages may be utilized. The score and/or threshold value may be defined differently for each stage.

Figure 10A:
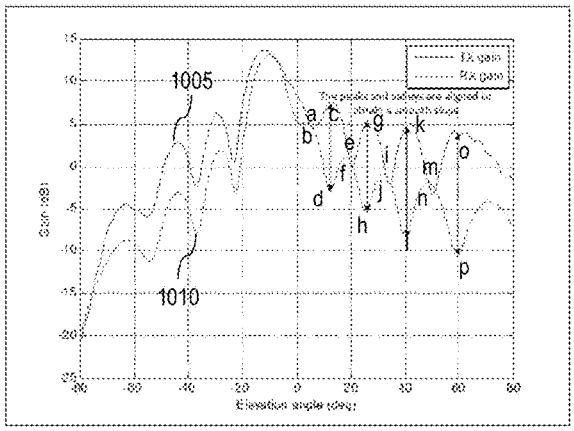
FIG. 10A illustrates a graph depicting examples of a transmitter radiation pattern and a receiver radiation pattern as a function of an elevation angle.

FIG. 10A illustrates a graph depicting examples of a TX radiation pattern 1005 and an RX radiation pattern 1010 as a function of an elevation angle. As illustrated in FIG. 10A, for at least a portion (e.g., between an elevation angle of around 0° to around 70°), the TX radiation pattern 1005 and RX radiation pattern 1010 compensate each other. In this regard, points a through p are labeled in FIG. 10A. Troughs a, e, i, and m of the TX radiation pattern 1005 are compensated by peaks b, f, j, and n of the RX radiation pattern 1010. Troughs d, h, l, and p of the RX radiation pattern 1010 are compensated by peaks c, g, k, and o of the TX radiation pattern 1005. In this regard, a local minimum of one radiation pattern (e.g., RX radiation pattern 1010) substantially coincides with a local maximum of another radiation pattern (e.g., TX radiation pattern 1005). In an aspect, the local extrema may substantially coincide when they are within +50 of each other. For example, the trough i of the TX radiation pattern 1005 is at an elevation angle of around 35° whereas the peak j of the RX radiation pattern 1010 is at an elevation angle of around 30°. In an aspect, the local extrema may substantially coincide when they are within ±1°, ±12, +±3, +4°, ±10° of each other, and all values in between.

Figure 10B:
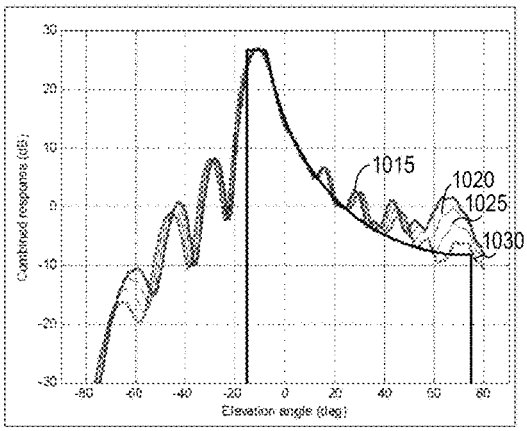
FIG. 10B illustrates a graph depicting antenna system radiation patterns, with each antenna system radiation pattern based on a combination of a transmitter radiation pattern and a receiver radiation pattern.

FIG. 10B illustrates a graph depicting antenna system radiation patterns 1015, 1020, 1025, and 1030, where each antenna system radiation pattern is based on a combination of a TX radiation pattern and an RX radiation pattern. For example, the antenna system radiation pattern 1015 may be based on a combination of the TX radiation pattern 1005 and the RX radiation pattern 1010 shown in FIG. 10A. Each of the antenna system radiation patterns 1015, 1020, 1025, and 1030 may represent an antenna system response for a different wavelength. As shown in FIG. 10B, the antenna system radiation patterns 1015, 1020, 1025, and 1030 follow a desired antenna system pattern, and are smooth at least between elevation angle of around −15° to around 70° due to the compensation of peaks and troughs of the TX radiation pattern, such as shown in the TX radiation pattern 1005, by the peaks and troughs of the RX radiation pattern, such as shown in the RX radiation pattern 1010, and vice versa.

Figure 10C:
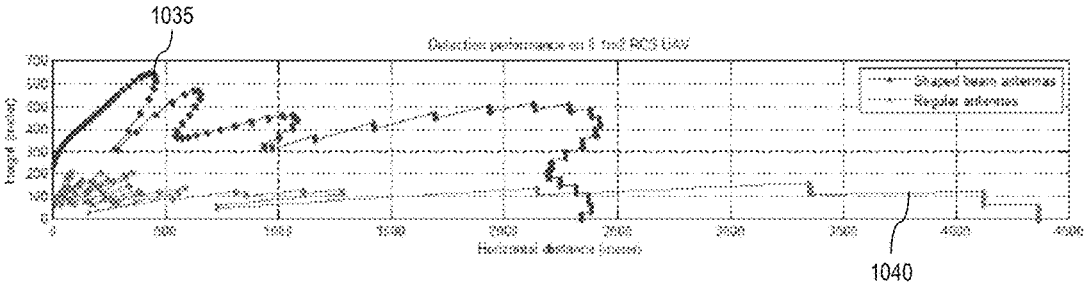
FIG. 10C illustrates an example of detection volumes associated with an antenna system radiation pattern.

FIG. 10C illustrates an example of a detection volumes 1035 and 1040 associated with an antenna system for a given target. In FIG. 10C, the target is a UAV with a radar cross section of 0.1 $m^2$. For instance, the detection volume 1035 may be associated with the antenna system radiation pattern 1015 of FIG. 10B, in which the antenna system radiation pattern is obtained based on conjoint beam shaping of the TX radiation pattern 1005 and RX radiation pattern 1010. The detection volume 1040 is associated with an antenna system radiation pattern in which the TX and RX antenna patterns are determined independent of each other. In radar applications, the detection volume may be a volume in which detection power is sufficient to detect objects. In other words, objects that fall within the detection volume can be reliably detected. As shown in FIG. 10C, the detection volume 1035 encompasses a higher height and lower horizontal distance compared to the detection volume 1040.

In one or more embodiments, the detection volumes 1035 and 1040 may be utilized in radar systems. In this regard, the detection volume 1035 may facilitate detection of objects at a constant flight altitude, such as UAVs at around 400 ft over a long horizontal distance. The detection volume 1040 may facilitate detection of objects at lower altitudes and longer distances compared to the detection volume 1035. In an embodiment, the radar system may be, may include, or may be a part of an antenna system that includes the TX device 210 and the RX device 215. The feedback EM radiation received by the RX device 215 when only a background scene is present may be used as a baseline for detecting objects.

Figure 11A:
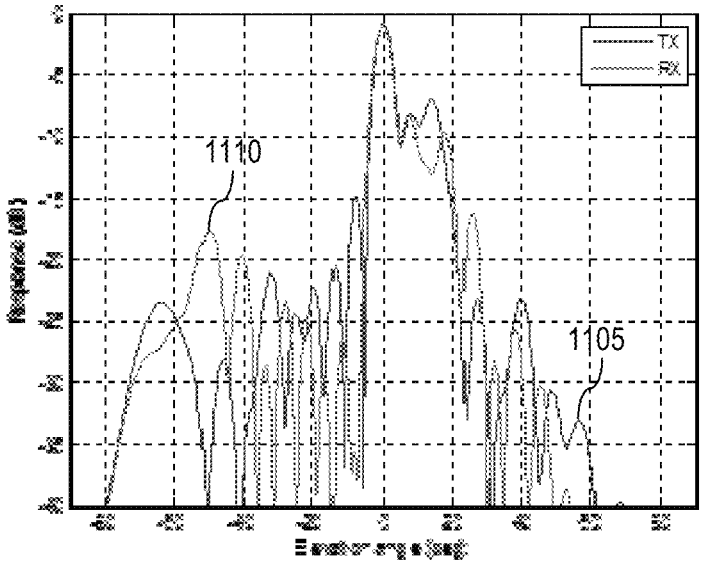
FIG. 11A illustrates a graph depicting examples of a transmitter radiation pattern and a receiver radiation pattern as a function of an elevation angle.
Figure 11B:
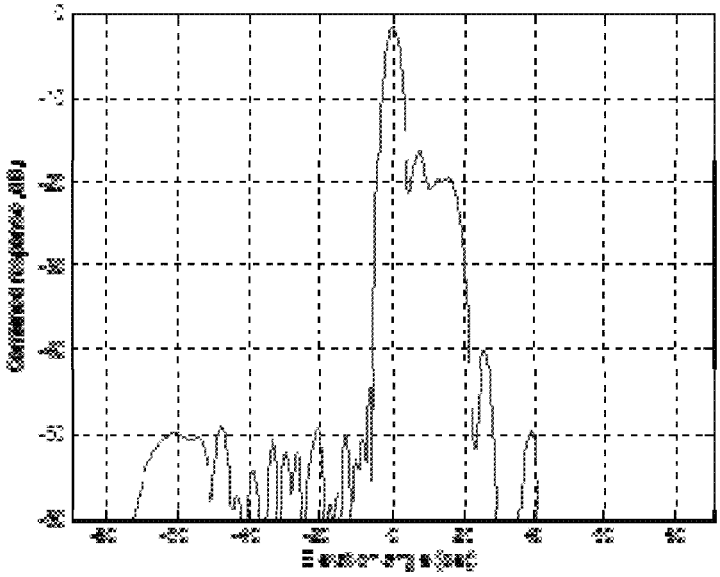
FIG. 11B illustrates a graph depicting an antenna system radiation pattern based on a combination of the transmitter and receiver radiation patterns shown in FIG. 11A.
Figure 12A:
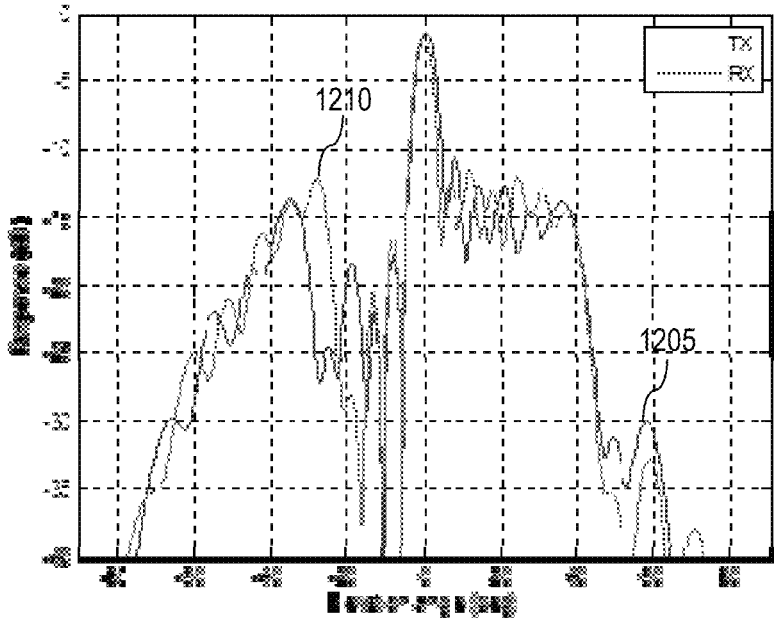
FIG. 12A illustrates a graph depicting examples of a transmitter radiation pattern and a receiver radiation pattern as a function of an elevation angle.
Figure 12B:
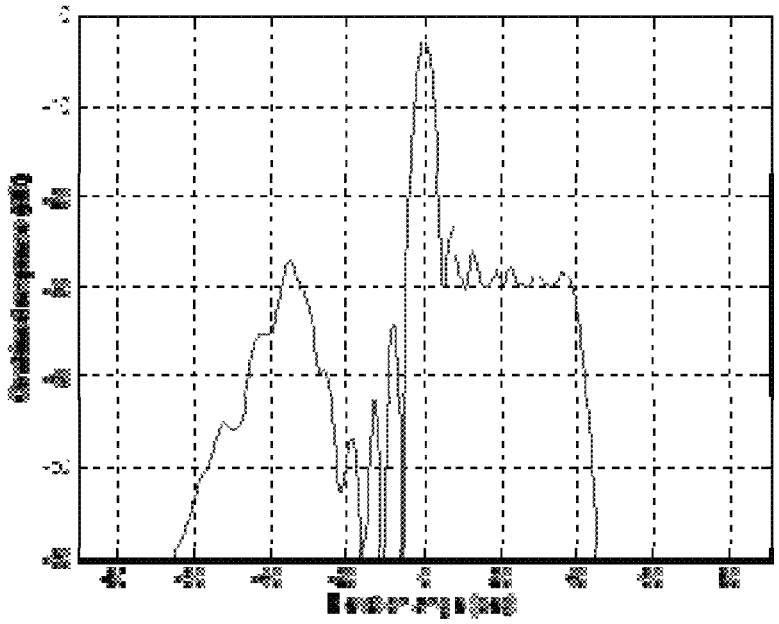
FIG. 12B illustrates a graph depicting an antenna system radiation pattern based on a combination of the transmitter and receiver radiation patterns shown in FIG. 12A.

FIG. 11A illustrates a graph depicting examples of a TX radiation pattern 1105 and an RX radiation pattern 1110 as a function of an elevation angle. FIG. 11B illustrates a graph depicting an antenna system radiation pattern based on a combination of the TX radiation pattern 1105 and RX radiation pattern 1110 shown in FIG. 11A. FIG. 12A illustrates a graph depicting examples of a TX radiation pattern 1205 and an RX radiation pattern 1210 as a function of an elevation angle. FIG. 12B illustrates a graph depicting an antenna system radiation pattern based on a combination of the TX radiation pattern 1205 and RX radiation pattern 1210 shown in FIG. 12A. As shown in the TX radiation patterns 1105 and 1205 and the RX radiation patterns 1110 and 1210, antenna parameters to effectuate the TX radiation patterns may be selected to compensate the RX radiation patterns, and vice versa.

Figure 13A:
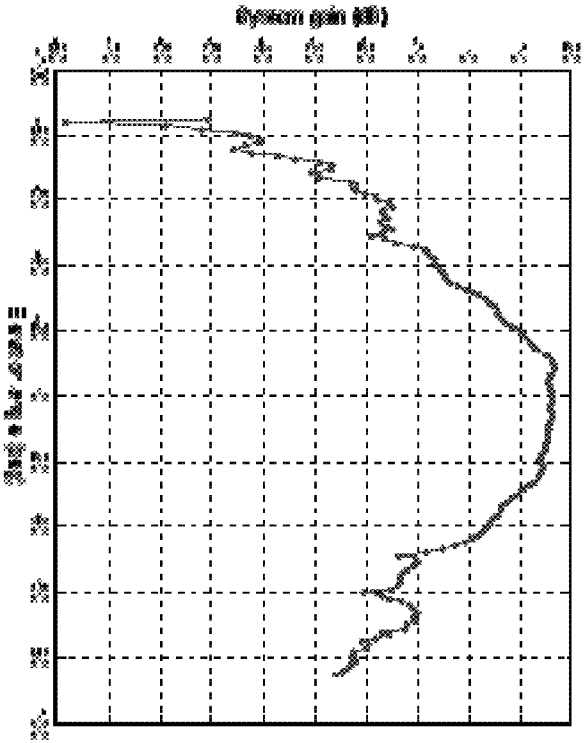
FIG. 13A illustrates a graph depicting an antenna system radiation pattern.
Figure 13B:
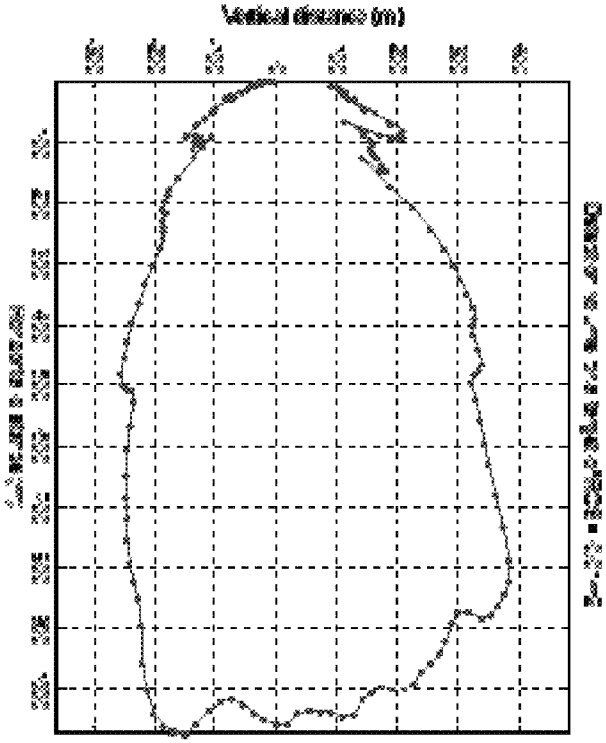
FIG. 13B illustrates an example of a detection volume associated with the antenna system radiation pattern shown in FIG. 13A.

FIG. 13A illustrates a graph depicting an antenna system radiation pattern. FIG. 13B illustrates an example of a detection volume associated with the antenna system radiation pattern shown in FIG. 13A for a given target. In FIG. 13B, the target has a radar cross section of 0.01 $m^2$.

Although the foregoing description is with reference to conjoint beam shaping in radar applications, conjoint beam shaping may be utilized with respect to mechanical waves rather than EM waves, such as in sonar applications. Where applicable, various embodiments provided by the present disclosure can be implemented using hardware, software, or combinations of hardware and software. Also where applicable, the various hardware components and/or software components set forth herein can be combined into composite components comprising software, hardware, and/or both without departing from the spirit of the present disclosure. Where applicable, the various hardware components and/or software components set forth herein can be separated into sub-components comprising software, hardware, or both without departing from the spirit of the present disclosure. In addition, where applicable, it is contemplated that software components can be implemented as hardware components, and vice versa.

Software in accordance with the present disclosure, such as non-transitory instructions, program code, and/or data, can be stored on one or more non-transitory machine readable mediums. It is also contemplated that software identified herein can be implemented using one or more general purpose or specific purpose computers and/or computer systems, networked and/or otherwise. Where applicable, the ordering of various steps described herein can be changed, combined into composite steps, and/or separated into sub-steps to provide features described herein.

The foregoing description is not intended to limit the present disclosure to the precise forms or particular fields of use disclosed. Embodiments described above illustrate but do not limit the invention. It is contemplated that various alternate embodiments and/or modifications to the present invention, whether explicitly described or implied herein, are possible in light of the disclosure. Accordingly, the scope of the invention is defined only by the following claims.

The invention claimed is:

1. A method, comprising:

determining a system pattern of an antenna system based at least on a first antenna pattern and a second antenna pattern, wherein the first antenna pattern is based on first antenna parameters, and wherein the second antenna pattern is based on second antenna parameters;

determining a score associated with the system pattern based at least on the determined system pattern and reference information, wherein the reference information comprises a reference value for a characteristic, and wherein the score is based on a difference between the reference value and a value for a corresponding characteristic associated with the determined system pattern; and adjusting the first antenna parameters and the second antenna parameters based at least on the score.

2. The method of claim 1, wherein the reference information is associated with a reference antenna pattern.

3. The method of claim 1, wherein the characteristic comprises antenna directivity.

4. The method of claim 1, wherein the first antenna pattern is selected to have a local minimum that substantially coincides with a local maximum of the second antenna pattern.

5. The method of claim 1, wherein:

the antenna system is associated with a transmitter antenna array and a receiver antenna array, the first antenna pattern comprises a transmitter antenna pattern associated with the transmitter antenna array, and the second antenna pattern comprises a receiver antenna pattern associated with the receiver antenna array.

6. The method of claim 5, wherein:

the first antenna parameters are associated with position, gain, and/or phase shift associated with each antenna element of the transmitter antenna array, and the second antenna parameters are associated with position, gain, and/or phase shift associated with each antenna element of the receiver antenna array.

7. The method of claim 5, further comprising forming the antenna system when the score associated with the system pattern is above a threshold value by:

forming the transmitter antenna pattern based on the first antenna parameters;

forming the receiver antenna pattern based on the second antenna parameters; and forming the system pattern based on the transmitter antenna pattern and the receiver antenna pattern, wherein the first antenna parameters and second antenna parameters are adjusted when the score is not above the threshold value.

8. The method of claim 1, wherein the score is a first score and the system pattern of the antenna system is a first system pattern of the antenna system, the method further comprising:

determining a third antenna pattern based on the adjusted first antenna parameters;

determining a fourth antenna pattern based on the adjusted second antenna parameters;

determining a second system pattern of the antenna system based on the third antenna pattern and the fourth antenna pattern;

determining a second score based on the determined second system pattern of the antenna system and second reference information; and further adjusting the first antenna parameters and the second antenna parameters based at least on the second score.

9. The method of claim 1, further comprising providing the first antenna parameters and the second antenna parameters for transmission when the score is above a threshold value.

10. A method, comprising:

determining a system pattern of an antenna system based at least on a first antenna pattern and a second antenna pattern, wherein the first antenna pattern is based on first antenna parameters, and wherein the second antenna pattern is based on second antenna parameters;

determining a score associated with the system pattern based at least on the determined system pattern and reference information;

adjusting the first antenna parameters and the second antenna parameters based at least on the score when the score is not above a threshold value;

configuring a transmitter circuit based on the first antenna parameters when the score is above the threshold value;

configuring a receiver circuit based on the second antenna parameters when the score is above the threshold value;

transmitting electromagnetic radiation using the transmitter circuit; and detecting at least one object based on a reflection of the transmitted electromagnetic radiation by the at least one object, the reflection being received using the receiver circuit.

11. The method of claim 10, wherein the reference information comprises a reference value for each of a plurality of characteristics.

12. The method of claim 10, wherein the reference information is associated with a characteristic, and wherein the characteristic comprises antenna directivity, location of a main lobe, gain associated with the main lobe, location of a back lobe, gain associated with the back lobe, location of a side lobe, gain associated with the side lobe, location of a null, half-power beamwidth, or null beamwidth.

13. A device, comprising:

one or more processors; and a non-transitory machine readable medium comprising instructions stored therein, which when executed by the one or more processors, cause the one or more processors to perform operations comprising:

determining a system pattern of an antenna system based at least on a first antenna pattern and a second antenna pattern, wherein the first antenna pattern is based on first antenna parameters, and wherein the second antenna pattern is based on second antenna parameters;

determining a score based at least on the determined system pattern and reference information;

adjusting the first antenna parameters and second antenna parameters based at least on the score;

determining a third antenna pattern based on the adjusted first antenna parameters;

determining a fourth antenna pattern based on the adjusted second antenna parameters;

determining a second system pattern of the antenna system based on the third antenna pattern and the fourth antenna pattern;

determining a second score based on the determined second system pattern of the antenna system and second reference information; and further adjusting the first antenna parameters and the second antenna parameters based at least on the second score.

14. The device of claim 13, further comprising:

a transmitter circuit configured based on the further adjusted first antenna parameters; and a receiver circuit configured based on the further adjusted second antenna parameters.

15. The device of claim 14, wherein:

the transmitter circuit is configured to transmit electromagnetic radiation;

the receiver circuit is configured to receive a reflection of the transmitted electromagnetic radiation by at least one object; and the operations further comprise detecting the at least one object based on the received reflection.

16. The device of claim 14, wherein the transmitter circuit comprises a first plurality of antenna elements, wherein the receiver circuit comprises a second plurality of antenna elements, wherein the first antenna parameters comprise position, gain, and/or phase shift associated with each of the first plurality of antenna elements, and wherein the second antenna parameters comprise position, gain, and/or phase shift associated with each of the second plurality of antenna elements.

17. The device of claim 13, wherein the first antenna pattern is selected to have a local minimum that substantially coincides with a local maximum of the second antenna pattern.

18. The device of claim 13, wherein the reference information comprises a reference antenna pattern.

19. The device of claim 13, wherein the reference information comprises a reference value for a characteristic, and wherein the score is based on a difference between the reference value and a value for a corresponding characteristic associated with the determined system pattern.

20. The device of claim 19, wherein the characteristic comprises antenna directivity.

* * * * *